US008561729B2

(12) United States Patent
King et al.

(10) Patent No.: US 8,561,729 B2
(45) Date of Patent: Oct. 22, 2013

(54) CASING BIT AND CASING REAMER DESIGNS

(75) Inventors: William W. King, Houston, TX (US); Michael Reese, Houston, TX (US); Steven W. Drews, Cypress, TX (US); Ian Alastair Kirk, Aberdeen (GB)

(73) Assignee: Varel International, Ind., L.P., Carrollton, TX (US)

( * ) Notice: Subject to any disclaimer, the term of this patent is extended or adjusted under 35 U.S.C. 154(b) by 387 days.

(21) Appl. No.: 12/793,489

(22) Filed: Jun. 3, 2010

(65) Prior Publication Data

US 2010/0307837 A1 Dec. 9, 2010

Related U.S. Application Data

(60) Provisional application No. 61/184,635, filed on Jun. 5, 2009.

(51) Int. Cl.
*E21B 10/43* (2006.01)
*E21B 17/14* (2006.01)

(52) U.S. Cl.
USPC ..... 175/398; 175/402

(58) Field of Classification Search
USPC ..... 175/398, 400, 416, 418, 20, 21, 402; 76/108.2, 108.4; 408/145; 166/242.8, 166/242.1; 405/253
See application file for complete search history.

(56) References Cited

U.S. PATENT DOCUMENTS 1,970,761 A 8/1934 McVicar
2,136,748 A 11/1938 Lottinger
2,196,528 A 4/1940 Hughes
2,207,920 A 7/1940 Hughes
2,215,913 A 9/1940 Brown
2,331,293 A 10/1943 Ballard (Continued)

FOREIGN PATENT DOCUMENTS

EP 0418706 A1 3/1991
GB 1153988 6/1969

(Continued)

OTHER PUBLICATIONS

PCT International Preliminary Report on Patentability mailed Dec. 15, 2011 for PCT/US2010/037330 (7 pages).
Hughes Christensen, "Reduce Risk, Ensure your casing gets to total depth", EZReam, Baker Hughes Inc, 2007 (4 pages).
"DrillShoe III, Drilling with Casing", Weatherford International Ltd., 2005-2008 (4 pages).
"DrillShoe II, 5-Blade Models, Drilling with Casing", Weatherford International Ltd., 2008 (4 pages).

(Continued)

*Primary Examiner* — Kenneth L Thompson
(74) *Attorney, Agent, or Firm* — Gardere Wynne Sewell LLP; Andre M. Szuwalski

(57) ABSTRACT

A casing end tool has a bowl-like (or cup-like) body defined by a wall having an outer convex surface and an inner concave surface opposite of the outer convex surface. The bowl-like body has a center axis. The inner concave surface is non-axisymmetric with respect to the center axis, while the outer convex surface is axisymmetric with respect to the center axis. The non-axisymmetric configuration is provided in one implementation through the presence of a set of raised boss or land structures formed on the inner concave surface. In another implementation, the non-axisymmetric configuration is provided by channels formed in the inner concave surface.

48 Claims, 7 Drawing Sheets

(56) References Cited

U.S. PATENT DOCUMENTS

| | | | | |
|---|---|---|---|---|
| 2,334,746 | A | 11/1943 | Brantly | |
| 2,357,330 | A | 9/1944 | Hyer | |
| 2,492,794 | A | 12/1949 | Goble et al. | |
| 2,493,178 | A * | 1/1950 | Williams, Jr. | 175/400 |
| 2,495,439 | A | 1/1950 | Brimble | |
| 2,642,267 | A | 6/1953 | Zublin | |
| 2,644,672 | A | 7/1953 | Mathews | |
| 2,658,284 | A | 11/1953 | Arps | |
| 2,669,429 | A | 2/1954 | Zublin | |
| 2,708,105 | A * | 5/1955 | Williams, Jr. | 175/400 |
| 2,869,825 | A | 1/1959 | Crawford | |
| 3,266,577 | A * | 8/1966 | Turner | 166/222 |
| 3,536,150 | A * | 10/1970 | Stebley | 175/263 |
| 4,101,318 | A | 7/1978 | Rudy | |
| 4,351,401 | A | 9/1982 | Fielder | |
| 4,382,477 | A | 5/1983 | Barr | |
| 4,478,298 | A | 10/1984 | Hake et al. | |
| 4,605,343 | A | 8/1986 | Hibbs, Jr. et al. | |
| 4,623,025 | A * | 11/1986 | Verstraeten | 175/21 |
| 4,696,354 | A | 9/1987 | King et al. | |
| 4,714,120 | A | 12/1987 | King | |
| 4,794,986 | A | 1/1989 | Langer | |
| 4,815,342 | A | 3/1989 | Brett et al. | |
| 4,823,892 | A | 4/1989 | Fuller | |
| 4,869,330 | A | 9/1989 | Tibbitts | |
| 4,889,017 | A | 12/1989 | Fuller et al. | |
| 4,956,238 | A | 9/1990 | Griffin | |
| 5,042,596 | A | 8/1991 | Brett et al. | |
| 5,090,492 | A | 2/1992 | Keith | |
| 5,127,923 | A | 7/1992 | Bunting et al. | |
| 5,244,039 | A | 9/1993 | Newton, Jr. et al. | |
| 5,259,469 | A | 11/1993 | Stjernstrom et al. | |
| 5,330,016 | A | 7/1994 | Paske et al. | |
| 5,346,025 | A | 9/1994 | Keith et al. | |
| 5,358,026 | A * | 10/1994 | Simpson | 164/98 |
| 5,441,121 | A * | 8/1995 | Tibbitts | 175/417 |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,651,421 | A | 7/1997 | Newton et al. | |
| 5,797,455 | A | 8/1998 | Barron et al. | |
| 5,826,651 | A | 10/1998 | Lee et al. | |
| 5,887,668 | A | 3/1999 | Haugen et al. | |
| 5,979,571 | A | 11/1999 | Scott et al. | |
| 6,039,127 | A | 3/2000 | Myers | |
| 6,062,326 | A | 5/2000 | Strong et al. | |
| 6,063,502 | A | 5/2000 | Sue et al. | |
| 6,138,756 | A | 10/2000 | Dale | |
| 6,145,607 | A | 11/2000 | Griffin et al. | |
| 6,298,930 | B1 | 10/2001 | Sinor et al. | |
| 6,401,820 | B1 | 6/2002 | Kirk et al. | |
| 6,439,326 | B1 | 8/2002 | Huang et al. | |
| 6,443,247 | B1 | 9/2002 | Wardley | |
| 6,460,631 | B2 | 10/2002 | Dykstra et al. | |
| 6,464,002 | B1 | 10/2002 | Hart et al. | |
| 6,510,906 | B1 | 1/2003 | Richert et al. | |
| 6,568,881 | B2 * | 5/2003 | Long | 405/248 |
| 6,612,383 | B2 | 9/2003 | Desai et al. | |
| 6,612,384 | B1 | 9/2003 | Singh et al. | |
| 6,620,308 | B2 | 9/2003 | Gilbert | |
| 6,655,481 | B2 | 12/2003 | Findley et al. | |
| 6,659,173 | B2 | 12/2003 | Kirk et al. | |
| 6,702,045 | B1 | 3/2004 | Elsby | |
| 6,725,939 | B2 | 4/2004 | Richard | |
| 6,817,633 | B2 | 11/2004 | Brill et al. | |
| 6,845,816 | B2 | 1/2005 | Kirk et al. | |
| 6,848,517 | B2 | 2/2005 | Wardley | |
| 7,066,253 | B2 | 6/2006 | Baker | |
| 7,096,982 | B2 | 8/2006 | McKay et al. | |
| 7,117,960 | B2 | 10/2006 | Wheeler et al. | |
| 7,216,727 | B2 | 5/2007 | Wardley | |
| 7,322,776 | B2 | 1/2008 | Webb et al. | |
| 7,395,882 | B2 | 7/2008 | Oldham et al. | |
| 7,426,969 | B2 | 9/2008 | Azar | |
| 7,757,793 | B2 | 7/2010 | Voronin et al. | |
| 7,998,573 | B2 | 8/2011 | Qian et al. | |
| 8,074,749 | B2 | 12/2011 | Twardowski et al. | |
| 2002/0170713 | A1 | 11/2002 | Haugen et al. | |
| 2004/0108739 | A1 | 6/2004 | Beeman et al. | |
| 2004/0188141 | A1 | 9/2004 | Slaughter et al. | |
| 2004/0226751 | A1 | 11/2004 | McKay et al. | |
| 2004/0228694 | A1 | 11/2004 | Webb et al. | |
| 2004/0244540 | A1 * | 12/2004 | Oldham et al. | 76/108.2 |
| 2004/0245020 | A1 | 12/2004 | Giroux et al. | |
| 2005/0103530 | A1 | 5/2005 | Wheeler et al. | |
| 2005/0145417 | A1 | 7/2005 | Radford et al. | |
| 2006/0070771 | A1 | 4/2006 | McClain et al. | |
| 2006/0124706 | A1 | 6/2006 | Raybould et al. | |
| 2007/0131459 | A1 | 6/2007 | Voronin et al. | |
| 2007/0175671 | A1 * | 8/2007 | Nava | 175/420.1 |
| 2007/0175672 | A1 | 8/2007 | Eyre et al. | |
| 2007/0187149 | A1 * | 8/2007 | Kristensen et al. | 175/57 |
| 2007/0193782 | A1 | 8/2007 | Fang et al. | |
| 2007/0246224 | A1 | 10/2007 | Krauss et al. | |
| 2007/0261890 | A1 | 11/2007 | Cisneros | |
| 2007/0277651 | A1 * | 12/2007 | Calnan et al. | 76/108.4 |
| 2007/0278017 | A1 | 12/2007 | Shen et al. | |
| 2007/0289782 | A1 | 12/2007 | Clark et al. | |
| 2008/0187403 | A1 | 8/2008 | Ertl et al. | |
| 2009/0078470 | A1 | 3/2009 | Lyons et al. | |
| 2009/0120693 | A1 | 5/2009 | McClain et al. | |
| 2009/0255664 | A1 | 10/2009 | Hart et al. | |
| 2010/0051349 | A1 | 3/2010 | Ballard et al. | |
| 2010/0166592 | A1 | 7/2010 | Uno et al. | |
| 2010/0282519 | A1 * | 11/2010 | Zhang et al. | 175/434 |
| 2011/0061941 | A1 * | 3/2011 | Twardowski et al. | 175/393 |
| 2011/0259604 | A1 | 10/2011 | Oldham et al. | |
| 2011/0259605 | A1 | 10/2011 | Oldham et al. | |
| 2011/0259606 | A1 | 10/2011 | Oldham et al. | |
| 2011/0259608 | A1 | 10/2011 | Oldham et al. | |
| 2011/0259643 | A1 | 10/2011 | Oldham et al. | |
| 2011/0266069 | A1 | 11/2011 | Oldham et al. | |
| 2011/0308813 | A1 | 12/2011 | Barron et al. | |
| 2012/0103694 | A1 | 5/2012 | Twardowski et al. | |

FOREIGN PATENT DOCUMENTS

| | | | |
|---|---|---|---|
| GB | 2339227 | B | 1/2000 |
| GB | 2369633 | A | 6/2002 |
| GB | 2429731 | B | 3/2007 |
| WO | WO-2010082051 | A2 | 7/2010 |

OTHER PUBLICATIONS

"DrillShoe II, 4-Blade Models, Drilling with Casing", Weatherford International Ltd., 2005-2007 (4 pages).

Sinor, Allen: "Casing Drilling—Recent Advances for Drilling Challenges," Hughes Christensen—A Baker Hughes Company, The Woodlands, TX, SPE Gulf Coast Section Jan. 10, 2001 (34 pages).

Office Action mailed Oct. 13, 2006 for U.S. Appl. No. 10/783,720 (27 pages).

Office Action mailed Apr. 20, 2006 for U.S. Appl. No. 10/783,720 (32 pages).

Tarr, Brian, et al.: "Casing-while-Drilling: The Next Step Change in Well Construction," Published in World Oil, Oct. 1999 issue (10 pages).

Sinor, L.A., et al.: "Rotary Liner Drilling for Depleted Reservoirs," IADC/SPE 39399, Mar. 3-6, 1998 (10 pages).

Galloway G.: "Rotary Drilling with Casing—A field proven method of reducing wellbore construction cost," World Oil Casing Drilling Technical Conference, Mar. 6-7, 2003 (7 pages).

McKay, D., et al.: "New Developments in the Technology of Drilling with Casing: Utilizing a Displaceable DrillShoe Tool," World Oil Casing Drilling Technical Conference, Mar. 6-7, 2003 (11 pages).

PCT International Search Report and Written Opinion cited in Application No. PCT/US2010/037330, dated Aug. 5, 2010 (8 pages).

Chinese First Office Action for 201080019941.X mailed Jul. 30, 2013 (13 pages).

International Search Report and Written Opinion for PCT/GB2010/050046 dated Sep. 21, 2010 (8 pages).

* cited by examiner

CASING BIT AND CASING REAMER DESIGNS

PRIORITY CLAIM

This application claims priority from U.S. Provisional Patent Application No. 61/184,635 filed Jun. 5, 2009, the disclosure of which is incorporated by reference.

CROSS REFERENCE TO RELATED APPLICATIONS

This application is related to U.S. Provisional Patent Application Nos. 61/182,442 filed May 29, 2009 (now U.S. application Ser. No. 12/789,416, filed May 27, 2010) and 61/182,382 filed May 29, 2009 (now U.S. application Ser. No. 12/787,349, filed May 25, 2010), the disclosures of which are incorporated by reference.

TECHNICAL FIELD

The present invention relates generally to drilling a wellbore, and more particularly to the drilling tools used at the end of a casing or liner within the wellbore. The present invention concerns drilling tools (and methods for forming drilling tools) that are attachable to a casing or liner string. In the context of the present invention, the terms casing and liner are used interchangeably.

BACKGROUND

In conventional drilling techniques, a longitudinally extending string comprising sections of drill pipe is secured to a drill bit of a larger diameter than the drill pipe. After a selected portion of the wellbore has been drilled, the drill string is removed and a string of tubular members of lesser diameter than the wellbore, known as a casing string, is placed in the wellbore. The annulus between the wall of the wellbore and the outside of the casing string is then filled with cement by pumping the cement down through a casing shoe or reamer shoe disposed at the end of the casing string.

In an alternative technique, designed to address the inefficiencies associated with making multiple wellbore trips in the conventional drilling technique discussed above, it is now known to drill with casing. In this technique, the drilling operation employs a drill bit, termed a casing bit, which is attached to the end of the casing string. The casing bit functions not only to drill the earth formation, but also to guide the casing string into the wellbore. The casing bit remains in place during subsequent cementing of the casing in place. The casing string is thus run into the wellbore as the wellbore is being formed by the casing bit. This eliminates the need for one or more extra trips to retrieve a drill string and drill bit after reaching a target depth where cementing is desired.

In either technique, additional drilling beyond the end depth of the casing string may be required. If so, the operator must drill out the casing end tool (shoe or bit) to reach the underlying formation. This is typically accomplished with a mill bit that is specifically designed to cut through the material from which the shoe is made. This has led to the development of casing end tools that are more readily drilled out. Primarily, such end tools use an aluminum alloy as the parent body material for the reamer nose or the cutting structure carrying face of the end tool. More recently, casing end tools made of alloyed steel have been commercialized and are run on casing prior to being drilled out with specially designed drill out PDC bits that carry an additional, standalone, overexposed tungsten carbide cutting structure to accomplish the drill out.

Prior art efforts relating to casing operations are set forth below. All references discussed herein are incorporated by reference.

U.S. Pat. No. 6,062,326 to Strong et al discloses a casing shoe/reamer with cutting means. The shoe/reamer has flutes (blades) that in one embodiment carry PDC cutters along the gage and across the nose of the tool. The tool is disclosed as being made either from drillable aluminum or non-drillable material. In one embodiment the nose section is designed to be segmented with the segments being hinged to the outer portion of the tool so the nose segments can be pushed out and forward prior to cementing or as part of the cementing process.

U.S. Pat. Nos. 6,401,820 and 6,659,173 to Kirk et al describe a shoe with reaming members and a nose portion of aluminum or zinc alloy to allow the nose to be drilled out.

U.S. Pat. No. 6,443,247 to Wardley describes a casing drilling shoe with an outer drilling section constructed of a hard material such as steel and an inner section constructed of a readily drillable material such as aluminum. It further includes a device for displacing the outer drilling section radially outwardly.

U.S. Pat. No. 6,848,517 to Wardley describes a drillable drill bit nozzle for use in a drill bit that is going to be drilled out.

U.S. Pat. No. 7,066,253 to Baker describes a casing shoe or reamer shoe with an outer body of relatively hard material and a nose of relatively soft material which are interlocked. A following drill bit is used to drill out the majority of the soft material leaving a sheath of the soft material in the internal circumference of the hard material.

U.S. Pat. No. 7,096,982 to McKay et al discloses a drill shoe with a body constructed of a relatively soft material which is set with blades of a relatively hard material. The blades, typically steel, are further set with PDC cutters. Once the desired depth of drilling has been achieved, a displacement element is activated to push out the soft material and bend the blades to the sidewalls of the annulus. The displacement element can then be drilled out with a following bit. McKay wants to provide a cutting structure support mechanism with the steel blades strong enough to handle drilling loads.

U.S. Pat. No. 7,117,960 to Wheeler et al describes a bit for drilling with a completion string that incorporates an integrated female non-shouldered oilfield completion string thread. The specification describes the bit as being manufactured from a material which does not allow the bit to be readily drilled.

U.S. Pat. No. 7,216,727 to Wardley discloses a casing drilling bit constructed from a relatively soft material such as aluminum, copper, or brass alloy and is coated with relatively hard material. The cutting means of the cutting members consist of fine layers or cutting elements formed from hard material.

U.S. Pat. No. 7,395,882 to Oldham et al is for "Casing and Liner Drilling Bits". This patent teaches making such tools with an axisymmetric inner profile to be evenly addressed by a subsequent drilling bit. It also teaches using nozzles deployed with sleeves, and gage sections that extend over the casing to which the tool is attached.

U.S. Patent Application Publication No. 2007/028972 to Clark et al is for "Reaming Tool Suitable for Running on Casing or Liner and Method of Reaming". This published application also teaches an axisymmetric inner profile and further states ". . . the absence of blades in the nose area projecting above the face of the nose allows for an uninterrupted cut of material of the body shell in the nose, making the reaming tool PDC bit-drillable."

U.S. Pat. No. 6,845,816 to Kirk et al teaches the use of an austemperized ductile iron (ADI) material for a centralizer. This material is more robust than aluminum and lighter than and more machinable than steel. See also, for example, ADI materials provided for sale by THDick.

Reference is also made to the Baker Hughes (Hughes Christensen) EZ Case Casing Bit System and the Weatherford International DrillShoe tools used for drilling with casing prior art devices (the disclosures of which are hereby incorporated by reference).

To summarize the prior art in this area, great attention has been given to the eventual drill out of the casing end tool, but little attention has been paid to the drilling efficiency of the casing end tool itself. Significant improvements to casing end tool performance can be made by adapting efficient drilling technology to the unique challenges of casing end tool structure and architecture. The other significant trade off in the prior art is in the choice of body material. Aluminum is readily drilled out but has a low resistance to erosion and abrasion, and cannot take the level of loading that steel is able to absorb. Alternatively, steel is more robust than aluminum but is much more difficult to drill out. If casing equipment is to be drilled out with a PDC bit then this has required the use of specially designed PDC drill out bits that compromise bit performance in the rock formations encountered after drill out.

What is needed are casing end tools (including casing bits and reamer shoes, liner drill in bits, liner reamers, and liner or casing mud motor driven reamers or mills) that perform effectively while drilling or reaming, are resistant to erosion, abrasion, and impact damage, and that can be effectively and consistently drilled out using standard PDC drill bits or cutter protected PDC bits.

SUMMARY

Casing end tools used for casing drilling and reaming or liner drill in or reaming are presented which overcome many of the previously noted shortfalls of the prior art. These tools employ advanced design and manufacturing techniques not previously practiced on casing end tools. A preferred, but non-limiting, embodiment of a casing bit is described. A casing reamer embodiment is also described.

Several approaches are incorporated in the construction of the superabrasive cutting elements for the casing end tool. These cutter element configurations are intended to reduce the total volume of tungsten carbide substrate material that has to be crushed, pushed aside, or flushed up hole as a part of the drill out of the casing end tool. In a typical superabrasive cutting element, the vast majority of its length is made of tungsten carbide. In a preferred embodiment of the casing end tool, an included cutter uses a short substrate. An alternative embodiment uses a short tungsten carbide substrate, bonded to an additional length of alternative substrate material such as steel or vanadium carbide. This allows for casing end tools that are designed around cutters of a traditional total length while reducing the total amount of hard cemented tungsten carbide material to be encountered during drill out.

In a preferred embodiment, the PDC or other superabrasive cutting element cutting structure is designed to be force balanced to within less than 10%, or less than 7%, or less than 5%, or less than 2%.

In an embodiment the casing end tool employs partially shallow leached or partially deep leached PDC cutters. In an embodiment the casing end tool employs fully leached cutters that have been reattached to a metal substrate through a second high pressure and high temperature (HP/HT) press cycle.

In an embodiment the casing end tool employs a cutter layout that has trailing or leading redundant, tracking, or plural cutters. These cutters may be mounted on the same blade as a set of primary cutters or may be mounted on a separate and distinct blade or blades.

In an embodiment the casing end tool uses cutter back up structures. These cutter back up structures may be cast from the parent body material or may be manufactured separately and pressed, glued or brazed in. These structures may be made of steel, tungsten carbide, vanadium carbide, tungsten carbide matrix, domed superabrasive, or may be diamond impregnated segments. The cutter back up structures may be slightly overexposed, equally exposed, or underexposed in comparison to their corresponding primary cutter. The cutter back up structures may be at the same radial distance, or at a slightly greater distance, or at a slightly lesser distance from bit centerline than their corresponding primary cutter.

In an embodiment the casing end tool uses a large number of ports or sleeved ports. If sleeves are used they may be made of thin walled tungsten carbide, vanadium carbide, ceramic, or steel. The casing end tool of this invention purposefully does not use replaceable or threaded nozzles to choke flow and create higher hydraulic horsepower per square inch, but rather relies on flow rate through a large number of relatively large inner diameter sleeved ports for cleaning and drilling efficiency while reducing the incidence of bit body erosion. In an embodiment the port sleeves are highly extended into the inner plenum of the casing end tool to move the active area of erosive flow away from the inner concave surface of the tool.

In an embodiment the casing end tool does not have a regular axisymmetric inner profile, but rather a non-axisymmetric pattern of raised bosses or lands creating an uneven, undulating and irregular surface (it being understood that "axisymmetric" means "exhibiting symmetry around an axis; or exhibiting cylindrical symmetry"). The point here is to increase the amount of interrupted cut during drill out (by an axisymmetric mill/drill bit) to stress the center part of the bit body and improve fragmentation during drill out. At least some of the raised bosses or lands are meant to provide increased contact and support area if highly extended port sleeves are used. In an embodiment the raised lands coincide with channels cast into or machined into the casing end tool nose or face. On a bladed bit the internal lands radiate out generally from the center and alternate with internal channels. Each internal land is positioned to generally correspond with an external facial fluid channel, while an internal channel is positioned to generally correspond with an external facial blade. Even in this instance the preferred embodiment is non-axisymmetry of the height and radial layout of the internal lands. During drill out the lands are drilled first thus increasing the likelihood of break up and fragmentation of the corresponding raised facial features on the nose or face of the casing end tool when it is drilled out.

In any of the bladed embodiments slits may be cut or cast in between some of the cutter pockets to increase the rate of fragmentation during drill out. In any of the embodiments blind holes may be drilled or cast into the face of the casing end tool. These holes do not break into the plenum of the tool. The purpose of the holes is to create interrupted cuts and fracture points across the casing end tool face to accelerate the break up and fragmentation of the end tool face during drill out.

In an alternative embodiment the inner concave surface is an axisymmetric inner profile.

Embodiments of casing end tools that will be used as reamers may or may not have cutters deployed across the full nose or face of the tool. Embodiments of casing end tools that will be used as reamers may have eccentric noses, or symmetric noses. If concentric, the nose or face may have a concave "cone" section. Alternative embodiments of casing end tools intended for use as reamers may use domed superabrasive cutting elements, or tungsten carbide domes, rather than flat faced cutting elements. Domed elements create less torque and are less likely to bite into the borehole wall. In an embodiment a centralizing inner collar of aluminum, phenolic, or similar is employed to stabilize the drill out bit during drill out of the casing end tool.

In a preferred embodiment the primary material used to manufacture the body of the casing end tool is made of an austemperized ductile iron (ADI) material.

In an embodiment the casing end tool is manufactured using an aluminum or aluminum alloy material.

In an alternative embodiment the casing end tool primary body is manufactured using a copper, brass, zinc alloy, steel, or titanium material.

In another embodiment the casing end tool primary body is cast from crystalline tungsten infiltrated with a brass binder. In this embodiment the parent body material may be "graded" with the inclusion of a volume of tungsten carbide powder or paste deployed on the outermost surface followed by a layer or layers of mixed tungsten carbide and crystalline tungsten ultimately ending with pure crystalline tungsten covering the distance to the inner concave surface of the casing end tool. The purpose of the graded powder layers is to enhance the erosion resistance of the nose or face of the tool while using highly machinable crystalline tungsten for the majority of the powder mix in the tool body casting. By grading the material an abrupt transition from a soft material to a hard material during drill out is avoided. In this infiltration embodiment an outer cylindrical shell is typically made of steel. This steel cylinder acts as the blank or casting mandrel as is known in the art. Typically a blank makes up the central body of an infiltrated drill bit. In the case of this invention the blank is a cylinder that is placed around the periphery of the milled facial features in a graphite casting mold. The steel cylinder may be fitted into a machined groove in the mold to accurately locate it relative to the facial features. When the mold is loaded with tungsten carbide, or crystalline tungsten or both the infiltration metal, typically a nickel brass alloy is positioned to infiltrate down into the powder(s) in a furnace cycle. Preferably the lower end of the steel blank cylinder is channeled and/or grooved to create a positive lock with the cast face of the tool. Any excess steel of the cylinder which protrudes below the face of the casting may be machined off. The great advantage of this embodiment is that it can take advantage of existing materials, design software, casting methods, and machine tools used in the manufacture of tungsten carbide matrix drill bits.

In an alternative embodiment, the casing end tool incorporates a float valve for use in cementing operations. In an alternative embodiment, the casing end tool employs a float valve that is offset from center to improve the drillability of the float valve.

In an embodiment, the casing end tool incorporates one or more frangible zones or bypass ports to provide an additional passage area for the flow of cement out of the casing end tool during the cementing of the casing.

In an embodiment, the body of the casing end tool is nitride treated to alter the surface electrical charge so as to enhance bit cleaning In an embodiment, the gage sections of the casing end tool are narrower in the uphole direction than they are in the downhole direction.

In an embodiment, the cutters on the casing end tool are deployed in pairs resulting in more, but shorter, blade sections. These blade sections are more likely to break up into smaller pieces during drill out making them easier to flush out of the hole.

In an embodiment, the central portion of the casing end tool is made by laser cutting or wire Electro Discharge Machining a cylinder, preferably of the parent body material, into pieces. These pieces are then tightly clamped together and machined for blades, pockets, and internal surface. The outer diameter is then threaded so that the center piece can be turned in a clockwise manner into a mating thread on the face of the main tool body, preferably stopping at an internal shoulder. When drilling downhole the forces on the cutter faces keep the center locked into the tool. Upon drill out by a following bit as the bit begins to machine away the internal surface of the casing end tool it will put torque on the threaded face insert to unscrew it in a counter-clockwise manner and allow it to come apart in more readily broken and flushed pieces.

In an embodiment, the casing end tool of the present invention is operated in conjunction with non-rotating casing centralizers to improve the transmission of weight and torque to the casing end tool.

In an embodiment, the cutters of the casing end tool are fitted with protective caps. In this instance the casing end tool has an enhanced capability of performing drill out through float equipment or a previously run and cemented casing end tool, or both.

In an embodiment, the upper gage sections of the casing end tool are set with up drill PDC cutters or other hard or superabrasive up drill cutting structure.

DETAILED DESCRIPTION OF THE DRAWINGS

Figure 1:
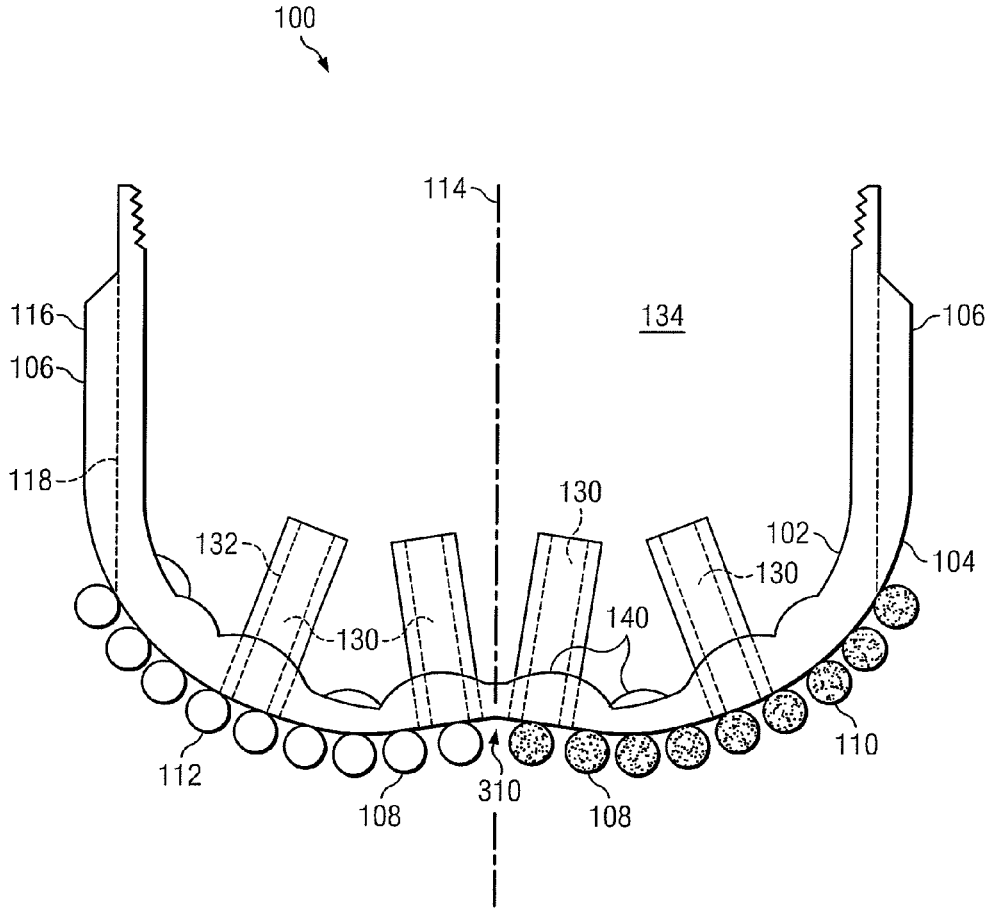
FIG. 1 is a simplified schematic cross-sectional illustration of a casing end tool in the form of a casing bit.

Reference is now made to FIG. 1 which shows a cross-sectional illustration of a casing end tool in the form of a casing bit 100 in accordance with an embodiment of the invention. The casing bit 100 has a bowl-like or cup-like configuration with an inner concave surface 102 defining a central plenum region and an outer convex surface 104. The inner and outer surfaces define opposed sides of a wall which surrounds the central plenum region. Formed on the outer convex surface 104 of the casing bit 100 are a number of blades 106. Each blade 106 supports a plurality of cutters 108. The dark shaded cutters 110 in the illustration are oriented on a first blade 106 with their diamond tables facing the viewer, while the light shaded cutters 112 in the illustration are oriented on another blade 106 (for example, radially opposite the first blade) with their diamond tables facing away from the viewer. The blades 106 extend outwardly from a central rotational axis 114 of the casing bit 100 to define the gage 116 of the bit. Junk slots 118 for the casing bit are positioned between blades 106.

In a preferred embodiment, the primary material used to manufacture the body of the casing end tool is austemperized ductile iron (ADI). In an embodiment, the casing end tool is manufactured using an aluminum or aluminum alloy material. In an alternative embodiment, the casing end tool primary body is manufactured using a copper, brass, zinc alloy, steel, or titanium material.

In another embodiment, the casing end tool primary body is cast from crystalline tungsten infiltrated with a brass binder. In this embodiment the parent body material may be "graded" with the inclusion of a volume of tungsten carbide powder or paste deployed on the outermost surface followed by a layer or layers of mixed tungsten carbide and crystalline tungsten ultimately ending with pure crystalline tungsten covering the distance to the inner concave surface of the casing end tool. The purpose of the graded powder layers is to enhance the erosion resistance of the nose or face of the tool while using highly machinable crystalline tungsten for the majority of the powder mix in the tool body casting. By grading the material an abrupt transition from a soft material to a hard material during drill out of the wall of the tool is avoided.

In this infiltration embodiment an outer cylindrical shell of the bit is typically made of steel. This steel cylinder acts as the blank or casting mandrel as is known in the art. Typically a blank makes up the central body of an infiltrated drill bit. In this instance, the blank is a cylinder that is placed around the periphery of the milled facial features in a graphite casting mold. The steel cylinder may be fitted into a machined groove in the mold to accurately locate it relative to the facial features. When the mold is loaded with tungsten carbide, or crystalline tungsten or both the infiltration metal, typically a nickel brass alloy is positioned to infiltrate down into the powder(s) in a furnace cycle. Preferably the lower end of the steel blank cylinder is channeled and/or grooved to create a positive lock with the cast face of the tool. Any excess steel of the cylinder which protrudes below the face of the casting may be machined off. The great advantage of this embodiment is that it can take advantage of existing materials, design software, casting methods, and machine tools used in the manufacture of tungsten carbide matrix drill bits.

In an alternative embodiment, the casing bit incorporates a float valve for use in cementing operations. In an alternative embodiment, the casing end tool employs a float valve that is offset from center to improve the drillability of the float valve. See, for example, Published U.S. Application for Patent No. 2007/0246224, the disclosure of which is incorporated by reference.

Several approaches are incorporated in the construction of the superabrasive cutting elements for the casing end tool of FIG. 1. These cutter element configurations are intended to reduce the total volume of tungsten carbide substrate material that has to be crushed, pushed aside, or flushed up hole as a part of the drill out of the casing end tool. Typical superabrasive cutting elements are 13 mm in diameter and 13 mm in length. The vast majority of the 13 mm length is of tungsten carbide.

Figure 2A:
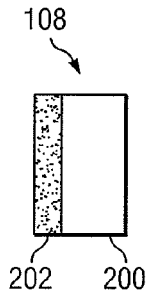
FIG. 2A is a side view of one embodiment of a cutter for use the tool of FIG. 1.

FIG. 2A shows a side view of one embodiment of a cutter 108 for use the tool of FIG. 1. This cutter, for example with a diameter ranging from 8 mm and 19 mm, uses a short tungsten carbide substrate 200 (for example, resulting in a total cutter length of 8 mm, or 5 mm, or 3 mm). The cutter further includes a diamond layer (table) 202.

Figure 2B:
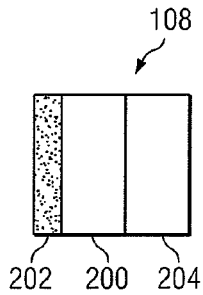
FIG. 2B is a side view of another embodiment of a cutter for use in the tool of FIG. 1.

FIG. 2B shows a side view of another embodiment of a cutter 108 for use in the tool of FIG. 1. This cutter also has a short tungsten carbide substrate 200. However, if a longer cutter is needed, the short tungsten carbide substrate 200 is bonded to an additional length of alternative substrate material 204 such as steel or vanadium carbide. This allows for casing end tools that are designed around cutters of a traditional total length to use cutters which reduce the total amount of hard cemented tungsten carbide material to be encountered during drill out.

The cutters of FIGS. 2A and 2B may employ diamond layers 202 that are partially shallow leached or partially deep leached (see, for example, U.S. Pat. Nos. 6,861,098, 6,861,137, 6,878,447, 6,601,662, 6,544,308, 6,562,462, 6,585,064, 6,589,640, 6,592,985, 6,739,214, 6,749,033, and 6,797,326, the disclosures of which are hereby incorporated by reference). In an alternative embodiment, the cutters of FIGS. 2A and 2B employ fully leached diamond tables 202 that have been reattached to the substrate 200 through a second high pressure/high temperature (HP/HT) press cycle (see, for example, U.S. Pat. No. 5,127,923, the disclosure of which is hereby incorporated by reference).

Reference is once again made to FIG. 1. The casing end tool includes a large number of ports 130. If desired, each port may comprise a sleeved port 132. If a port sleeve 132 is used for a given port 130, the sleeve may be made of thin walled tungsten carbide, vanadium carbide, ceramic, or steel. The casing end tool purposefully does not use replaceable or threaded nozzles which can choke flow and create higher hydraulic horsepower per square inch. Instead, the tool relies on flow rate through a large number of relatively large inner diameter ports 130 (sleeved ports 132) for cleaning and drilling efficiency while reducing the incidence of bit body erosion. In an embodiment the port sleeves 132 are highly extended into the inner plenum 134 of the casing end tool to move the active area of erosive flow away from the inner concave surface 102 of the tool.

In an embodiment the casing end tool does not have a regular or symmetric inner concave surface 102 profile but rather has an inner concave surface 102 with a non-axisymmetric pattern of raised bosses 140 or lands. This creates an uneven, undulating inner concave surface and thus an irregular inner profile. The point of this feature is to increase the amount of interrupted cut in the total bit body during drill out by a mill/drill bit which would present an axisymmetric face in contact with the inner concave surface 102. This will stress the center part of the tool bit body and improve fragmentation of the casing end tool during drill out. It will thus be much easier for the drill out operation to be completed. The outer convex surface 104 of the tool, on the contrary defines an axisymmetric shape.

In an alternative embodiment, the inner concave surface 102 of the casing end tool may have an axisymmetric inner profile which preferably does not match the axisymmetric face of the mill/drill bit.

At least some of the raised bosses 140 or lands provide an additional function in that they increase the thickness of the casing end tool structure at and around the ports 130. This is important to provide increased contact and support area if highly extended port sleeves 132 are used. The port sleeves 132 extend, for example, at least ¼ from the surrounding raised boss 140 or land.

In an embodiment the body of the casing end tool is nitride treated to alter the surface electrical charge to enhance bit cleaning. See, for example, U.S. Pat. No. 5,330,016, the disclosure of which is incorporated by reference.

In an embodiment the gage sections 116 of the casing end tool have a width that narrows in the uphole direction from the downhole direction. See, for example, U.S. Pat. No. 4,696,354, the disclosure of which is hereby incorporated by reference. This is not explicitly shown in FIG. 1.

The casing end tool may incorporate one or more frangible zones or bypass ports to provide an additional passage area for the flow of cement out of the casing end tool during the cementing of the casing.

In an embodiment, the casing end tool of the present invention is operated in conjunction with non-rotating casing centralizers to improve the transmission of weight and torque to the casing end tool. See, for example, U.S. Pat. No. 5,797,455, the disclosure of which is hereby incorporated by reference.

Figure 3:
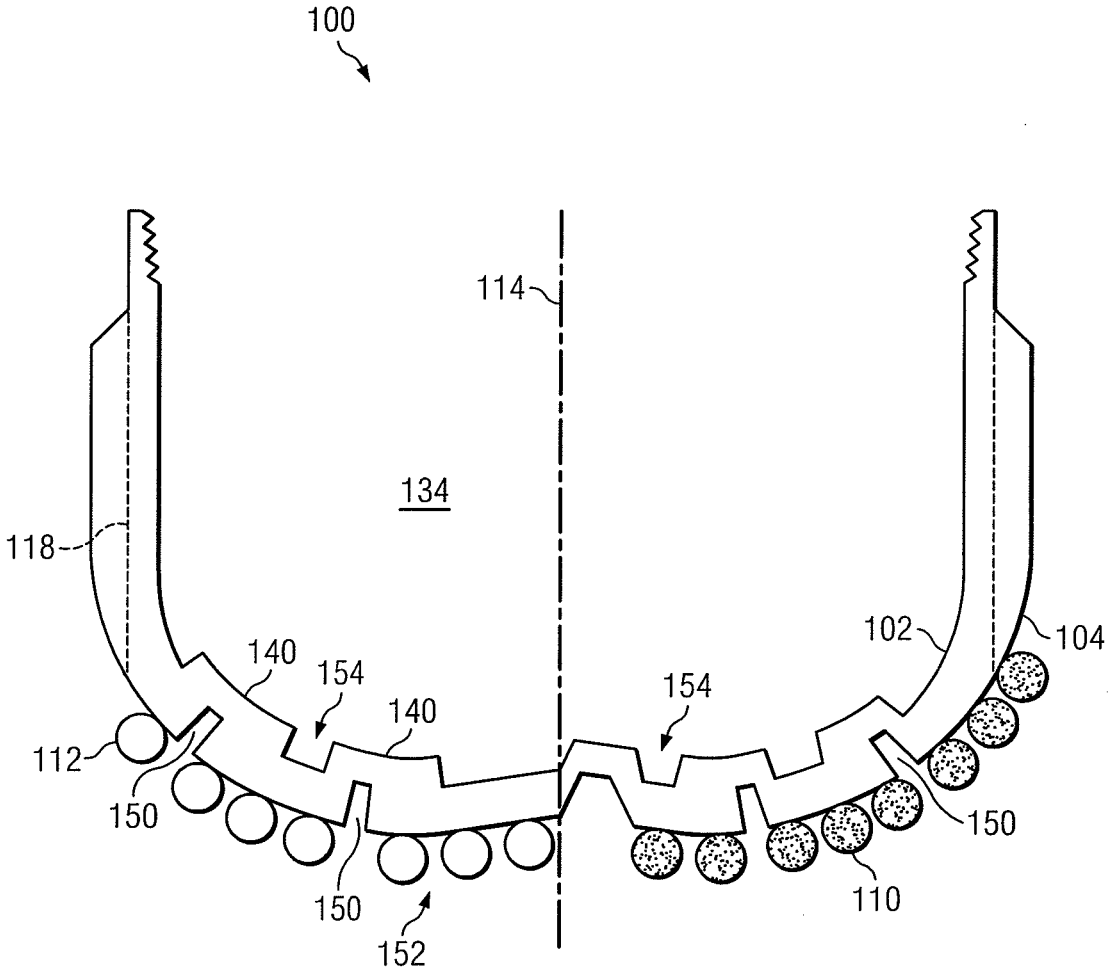
FIG. 3 is a simplified schematic cross-section illustrating that the position of some raised bosses/lands coincides with channels in the casing end tool nose or face.

In an embodiment, the position of some of the raised bosses/lands 140 coincides with channels 150 in the outer surface 104 that are cast into or machined into the casing end tool nose or face 152. This is shown in the cross-section of FIG. 3. The ports and port sleeves are omitted from FIG. 3 for reasons of clarity. The raised boss/land 140 with corresponding channel 150 is provided to create an uneven, undulating inner concave surface 102 (with an irregular inner profile) so as to increase the amount of interrupted cut of the body during drill out and support improved fragmentation of the casing end tool during drill out. The channels 150 are formed on the outer convex surface 104, while channels 154 are formed on the inner concave surface 102. Preferably, when included on both surfaces, the position of the channels 150 and 154 is offset as shown.

Figure 4:
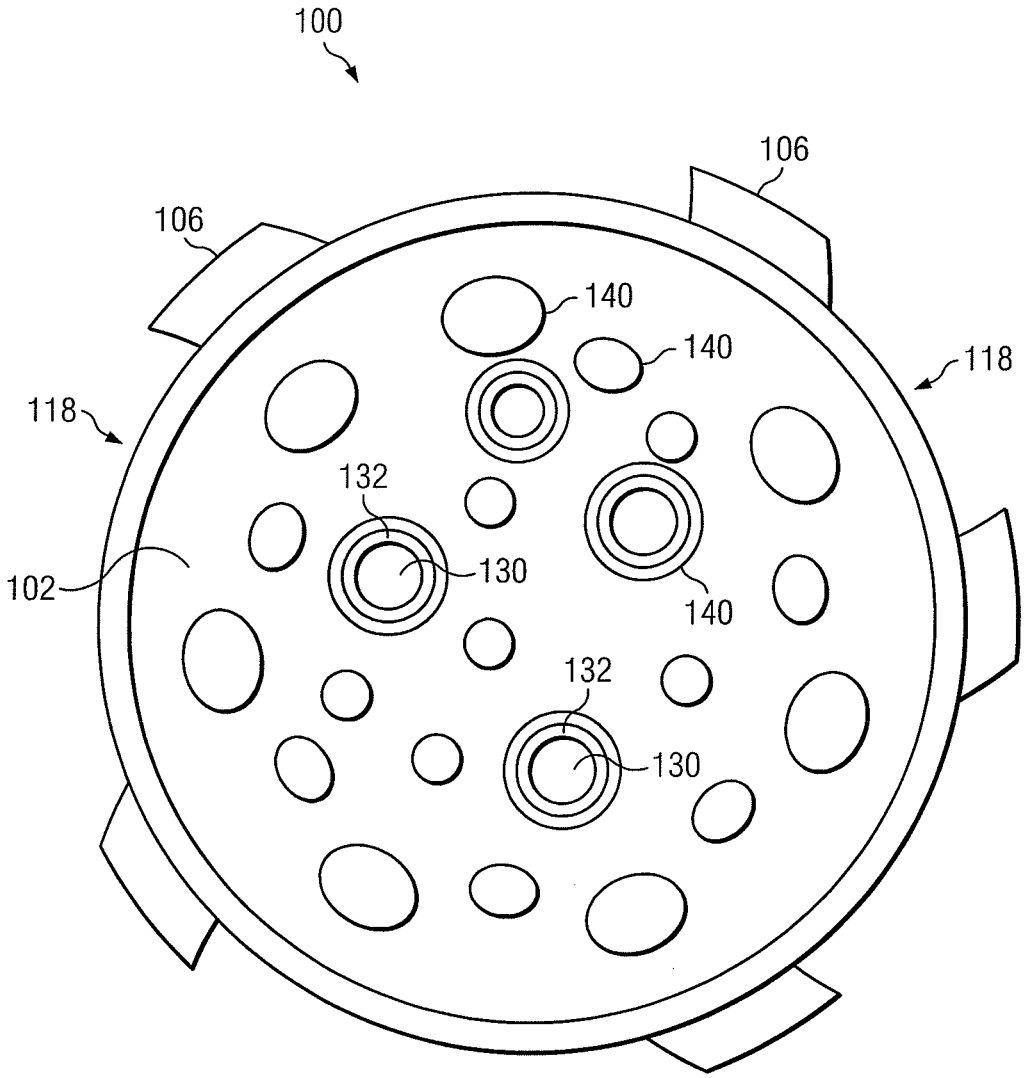
FIG. 4 is a plan view of the internal surfaces of a casing bit of FIG. 1.

Reference is now made to FIG. 4 which shows a plan view of the casing bit 100 of FIG. 1. The view in FIG. 4 is looking into the bowl-like or cup-like configuration towards the inner concave surface 102. The raised bosses 140 are generally shown with a circular/oval shape as a matter of convenience and not limitation as the bosses can take on any desired shape which supports the formation of a non-axisymmetric pattern on the inner concave surface. The illustration of an oval shape, as opposed to circular shape, is provided to indicate that the boss feature of interest is located more on a side inside surface than a bottom inside surface of the tool. FIG. 4 further shows how a boss 140 has been associated with the location of each highly extended port sleeve 132.

Figure 5:
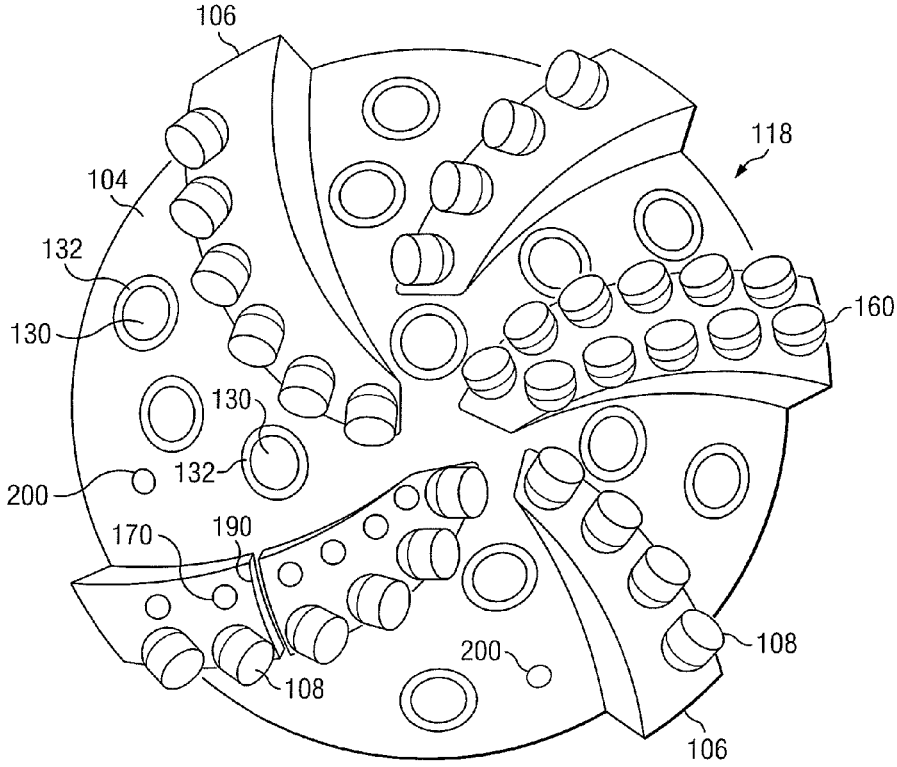
FIG. 5 is a plan view of the casing end tool of FIG. 1.

Reference is now made to FIG. 5 which shows a plan view of the casing end tool of FIG. 1. The view in FIG. 5 is looking at the face (outer convex surface 104) of the bit 100. The bit includes a plurality of blades 106, each having a spiral configuration. It will be noted that the blades 106 could, alternatively, be straight blades as known in the art. The layout of the blades 106 is asymmetric, but it will be understood that a symmetric blade could alternatively be used.

In an embodiment, as shown in FIG. 5, the casing bit 100 employs a cutter layout on one or more blades that has trailing or leading redundant, tracking, or plural cutters 160. See, for example, U.S. Pat. Nos. 5,549,171, 5,551,522, 5,582,261, and 5,651,421, the disclosures of which are incorporated by reference. These cutters 160 may be mounted on the same blade as a set of primary cutters 108 or may be mounted on a separate and distinct blade 106 or blades.

In an embodiment, the cutters 108 on the casing bit are deployed in pairs resulting in more but shorter blade sections. See, for example, U.S. Pat. Nos. 4,714,120, the disclosure of which is hereby incorporated by reference. These blade sections are more likely to break up into smaller pieces during drill out making them easier to flush out of the hole.

In an embodiment, as shown in FIG. 5, the casing bit 100 includes on at least one blade a set of cutter back up structures 170. See, for example, U.S. Pat. Nos. 5,090,492, 5,244,039, 4,889,017, and 4,823,892, the disclosures of which are incorporated by reference. The cutter back up structures 170 may be cast from the parent body material or may be manufactured separately and pressed, glued or brazed in. These structures may be made of steel, ADI, tungsten carbide, vanadium carbide, tungsten carbide matrix, crystalling tungsten matrix, domed superabrasive, or may be diamond impregnated segments. The cutter back up structures 170 may be slightly overexposed, equally exposed, or underexposed in comparison to their corresponding primary cutter. The cutter back up structures 170 may be at the same radial distance, or at a slightly greater distance, or at a slightly lesser distance from bit centerline than their corresponding primary cutter 108.

In an embodiment the upper gage 116 sections of the casing end tool are set with up drill PDC cutters or other hard or superabrasive up drill cutting structure.

In a preferred embodiment, the casing bit 100 includes a PDC or other superabrasive cutting element cutting structure that is designed to be force balanced. See, for example, U.S. Pat. Nos. 4,815,342, and 5,042,596, the disclosures of which are incorporated by reference. Such force balancing is preferably designed to be within less than 10%, or less than 7%, or less than 5%, or less than 2%.

Force balancing may be performed with respect to the bit under several different (or over a range of) cutting conditions.

In an embodiment wherein the casing end tool is a reamer to be used in an existing wellbore, force balancing is accomplished by assuming incremental constriction diameters. For instance a simulated tool run of the reamer is performed assuming a 0.125" reduction in the original hole diameter and the tool is force balanced to reflect the cutting done at the assumed constriction diameter. Afterwards further simulated tool runs are performed assuming greater reductions in the original hole size with force balancing being performed at each step. Eventually the reamer design is force balanced across a range of anticipated hole diameters so that in application of the actual reamer it will be force balanced for the actual constriction diameter that exists in the wellbore. See, U.S. Patent Application Publication No. 2010/0051349, the disclosure of which is incorporated by reference.

Figure 6A:
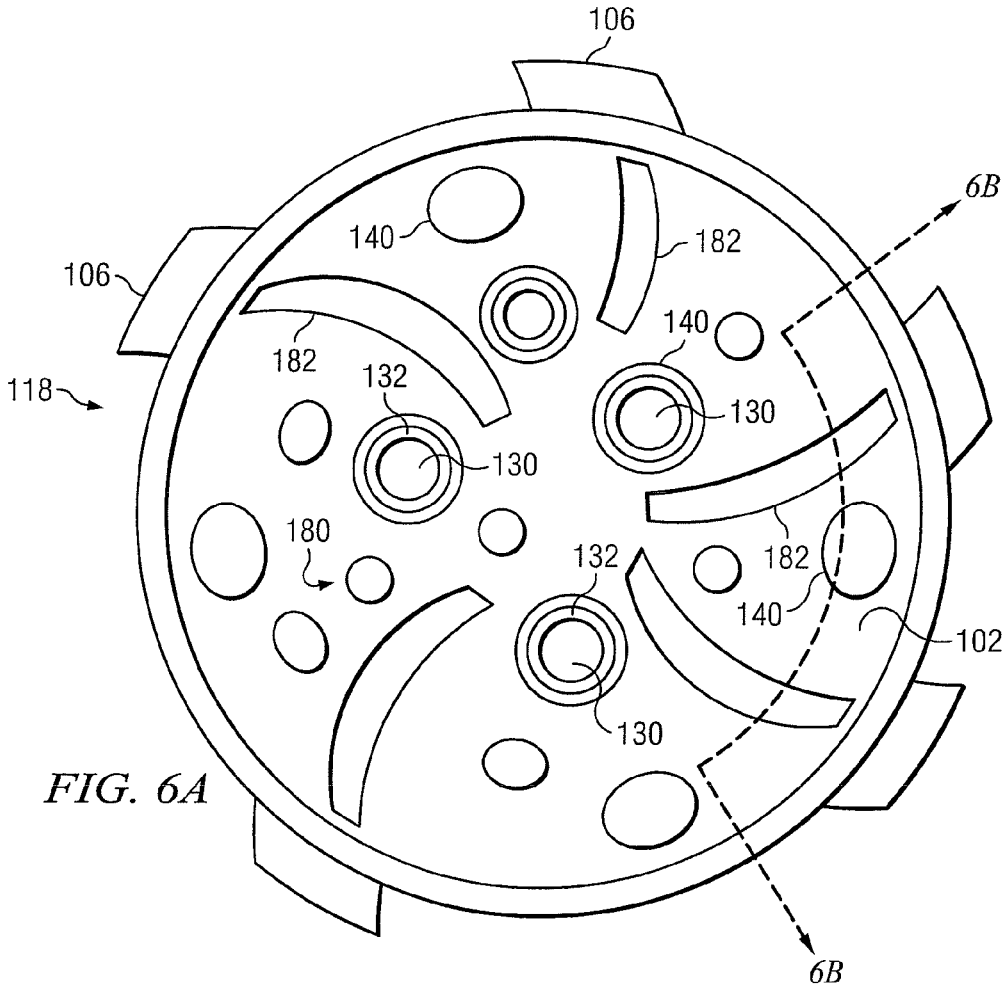
FIG. 6A is a plan view of the casing end tool of FIG. 1 similar to that shown in FIG. 4.
Figure 6B:
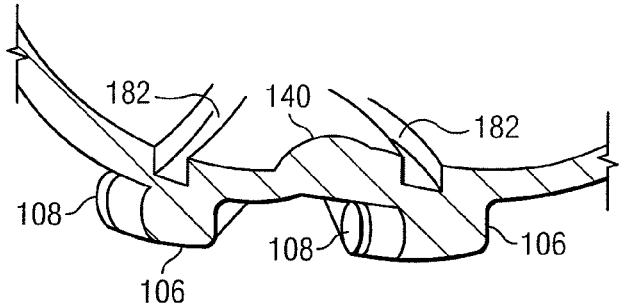
FIG. 6B is a partial broken-away sectional view of FIG. 6A.

Reference is now made to FIG. 6A which shows a plan view of the casing end tool of FIG. 1 similar to that shown in FIG. 4. The view in FIG. 6A, like that of FIG. 4, is looking into the bowl-like or cup-like configuration towards the inner concave surface 102. On a bladed bit the provision of groups 180 of internal bosses/lands 140 radiate out generally from the center. These groups of lands 140 alternate with an internal channel 182 formed in the inner concave surface 102 of the bit. In this configuration, a group 180 of internal bosses/lands generally corresponds with an external facial fluid channel (junk slot). Each of the included internal channels 182 generally corresponds with an external facial blade 106. Even in this instance the preferred embodiment is non-axisymmetric of the height and radial layout of the internal lands. During drill out the lands are drilled first by the axisymmetric face of the mill/drill bit thus increasing the likelihood of break up and fragmentation of the corresponding raised facial features on the nose or face of the casing end tool. A partial broken-away sectional view of FIG. 6A is provided in FIG. 6B.

In any of the bladed embodiments described above, slits 190 may be cut or cast in the blades 106 between some of the cutter pockets, as shown in FIG. 5, in order to increase the rate of fragmentation of the casing bit during drill out. See, also FIG. 3 and the illustrated channels 150 as an implementation of the slits 190.

In any of the embodiments described above, one or more holes 200 may be drilled or cast into the face of the casing bit (as shown in FIG. 5). Importantly, these are blind holes which do not break into the plenum of the tool. The purpose of these blind holes 200 is to create interrupted cuts and fracture points across the end tool face to accelerate the break up and fragmentation of the end tool face during drill out. Alternatively, the blind holes can be provided on the inner concave surface.

Figure 7:
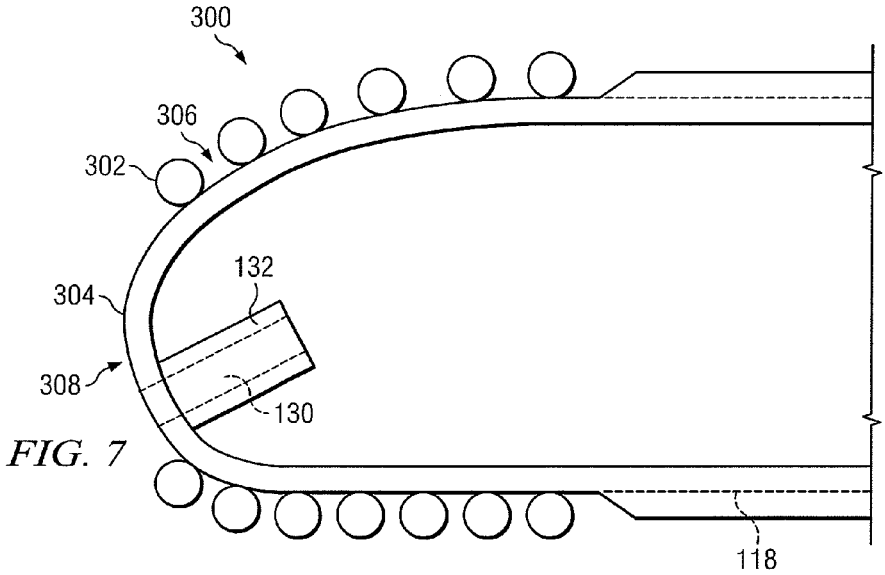
FIG. 7 is a casing reamer.

Reference is now made to FIG. 7 showing a casing reamer 300. Embodiments of casing end tools in accordance with the descriptions provided herein can comprise a reamer. The reamer 300 may or may not have cutters 302 deployed across the full nose 304 or face 306 of the tool. Embodiments of casing end tools that will be used as reamers may have eccentric noses 308, or symmetric noses. If concentric the nose 304 or face 306 may have a concave "cone" section 310 (see, FIG. 1). Alternative embodiments of casing end tools intended for use as reamers may use domed superabrasive cutting elements, or tungsten carbide domes, rather than flat faced cutting elements. Domed elements create less torque and are less likely to bite into the borehole.

Figure 8:
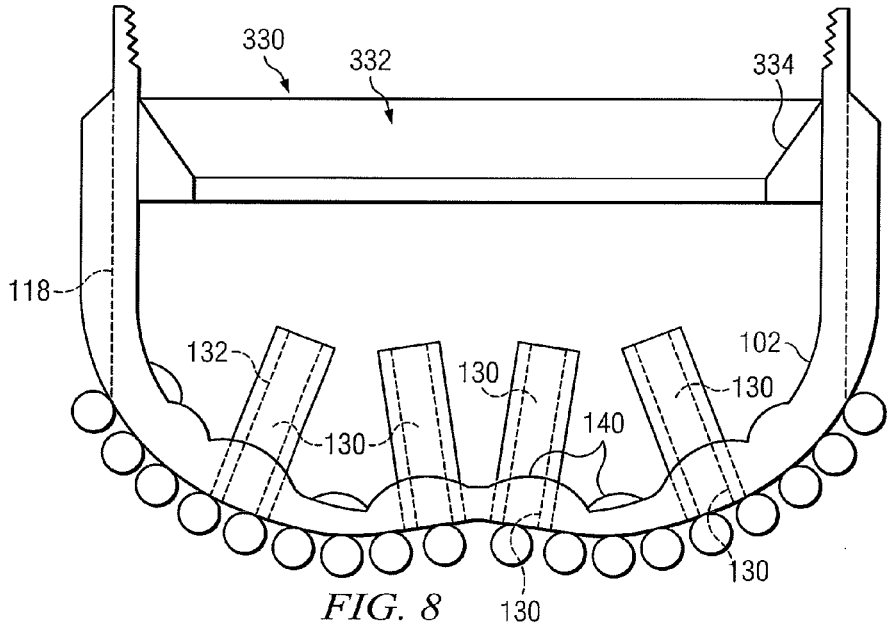
FIG. 8 is a simplified schematic cross-sectional view of a casing bit (as shown in FIG. 1, for example) further including an inner collar.

Reference is now made to FIG. 8 which shows a cross-sectional view of the casing bit 100 (as shown in FIG. 1, for example) further including an inner collar 330. The inner collar 330 may be made of aluminum, phenolic, or similar material. The inner collar 330 has a central opening 332 aligned with the bit axis and sloped sides 334, and functions to stabilize the drill out bit (for example, a mill bit) during drill out of the casing end tool.

Figure 9:
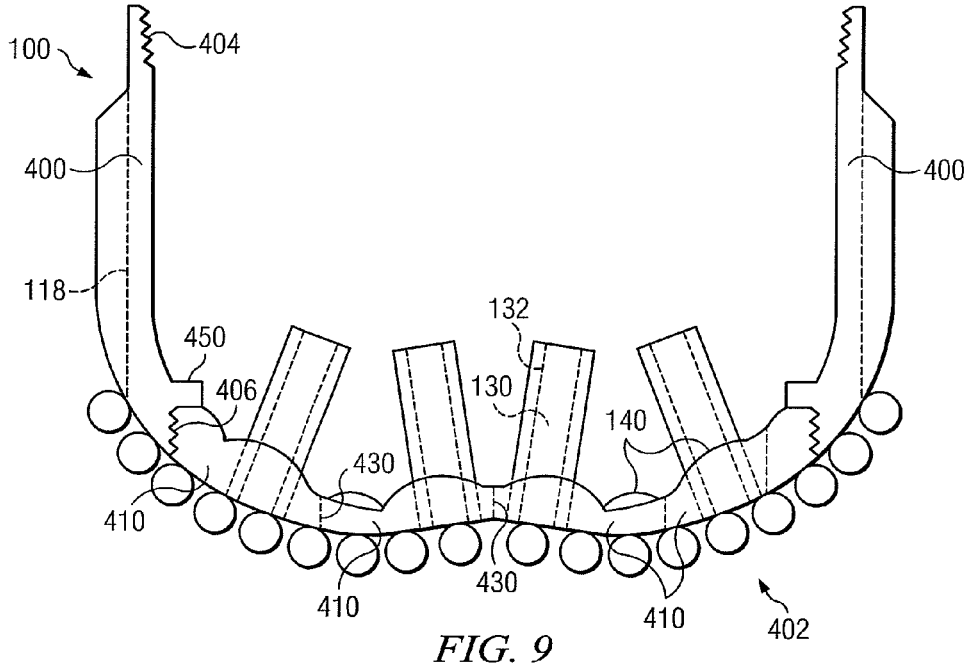
FIG. 9 is a simplified schematic cross-sectional illustration of another embodiment of a casing bit.
Figure 10:
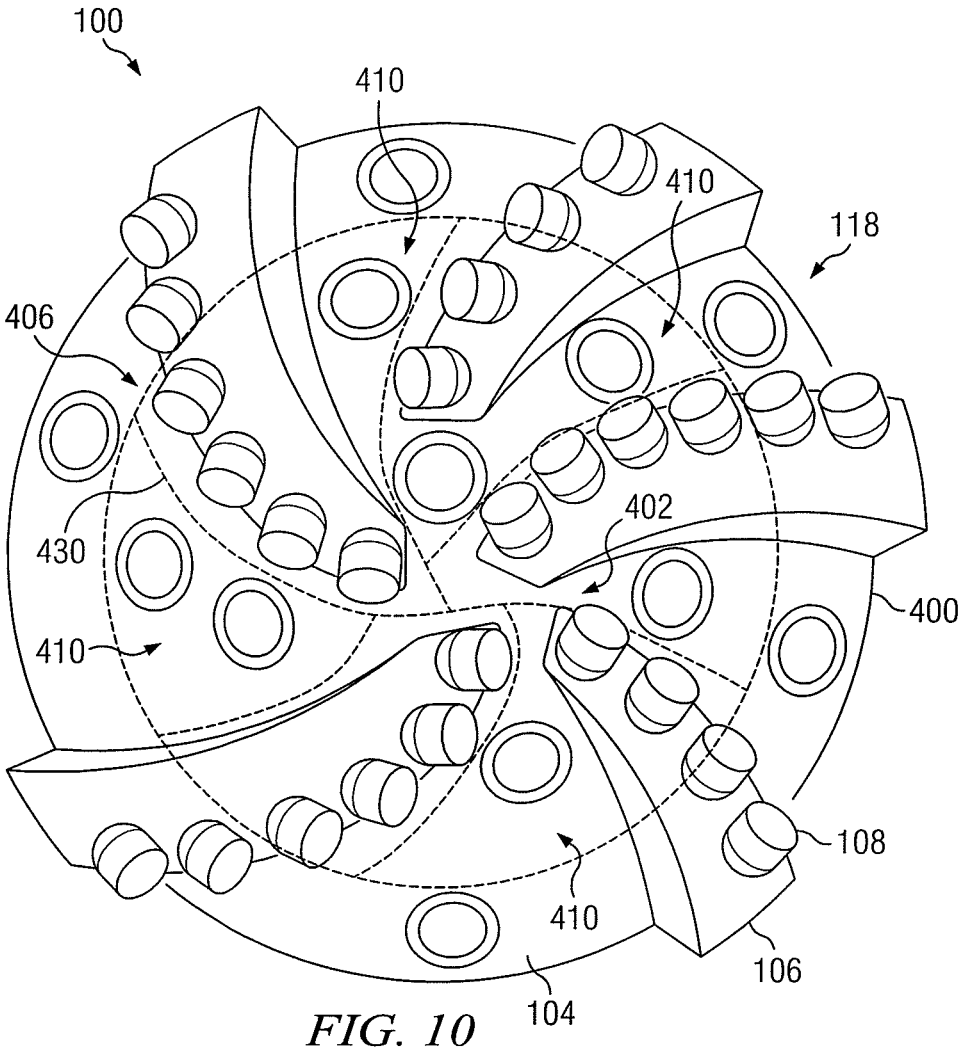
FIG. 10 is a plan view of the face of the bit shown in FIG. 9.

Reference is now made to FIG. 9 which shows a cross-sectional illustration of another embodiment of a casing bit 100. FIG. 10 shows a plan view of the face of the bit shown in FIG. 9. In this embodiment, the casing bit 100 is formed from a cylindrical sidewall portion 400 and a multi-sectional nose portion 402. The cylindrical sidewall portion 400 is threaded 404 on an inner wall surface at a top end for connection to the casing. The cylindrical sidewall portion 400 is further threaded 406 on an inner wall surface at a bottom end for connection to the multi-sectional nose portion 402. The multi-sectional nose portion 402 is assembled from a plurality of nose pieces 410. The assembly of nose pieces 410 has an outer diameter that is threaded to mate with the threading 406 on the bottom end of the cylindrical sidewall portion. The nose portion assembly 402, as a whole, is screwed into the cylindrical sidewall portion 400 in a first direction which is opposite the direction of rotation of the casing bit 100 when engaging the formation. Thus, rotation of the casing bit 100 during formation drilling will reinforce threaded engagement between the nose portion assembly 402 and the cylindrical sidewall portion 400.

The dotted lines 430 in FIGS. 9 and 10 show locations in the cross-section and plan view where one nose piece 410 of the nose portion assembly 402 ends and another nose piece 410 begins. The screwing in of the nose portion assembly 402 acts like clamp to secure the individual pieces 410 of the nose portion assembly together. The clamping effect is made in a radial inward direction. The fit of the various nose portion pieces 410 together must be precise. In a preferred implementation, wire electrodischarge machining (EDM) is used to define the edges (lines 430) of each piece 410 in relation to other pieces. It will be understood, however, that any other precision machining technique (such as laser cutting) could alternatively be used to form the pieces 410 of the nose assembly 402.

The nose assembly 402 can be cut apart into pieces from a single parent body material. These pieces 410 may then be tightly clamped together and machined to form the blades, pockets, and internal surface of the casing bit (as described herein). The outer diameter is then threaded so that the center piece can be turned in the first direction (for example, clockwise) into a mating thread 406 on the inner surface of the cylindrical sidewall portion 400. Rotation in the first direction during assembly is preferably stopped by an internal shoulder 450. When downhole drilling is performed, the forces on the cutter faces reinforce the first direction rotation and keep the nose assembly 402 locked into the tool.

The advantage of providing the multi-sectional (piece 410) nose portion assembly 402 is realized when the casing bit 100 must subsequently be drilled out. When this occurs, the mill/drill bit which is lowered into the borehole and rotated will not only begin to machine away the internal surface 102 nose assembly for the casing bit, but engagement of the mill/drill bit cutters on that internal surface 102 will put torque on the nose assembly 402 in a second direction (for example, counter-clockwise) opposite that used to reinforce threaded engagement. The nose assembly 402 will thus unscrew from cylindrical sidewall portion 400. Without the threaded clamping engagement, the nose assembly 402 will come apart into multiple pieces 410 and then be more readily broken and flushed from the borehole to complete drillout of the casing bit 100.

Figure 11:
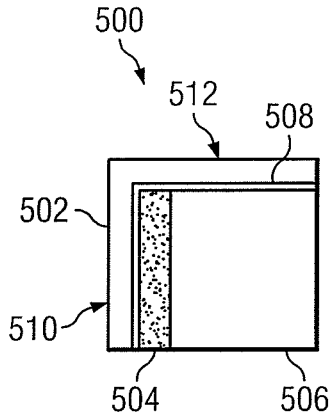
FIG. 11 is a side view of a cutter in accordance with another embodiment.

Reference is now made to FIG. 11 which shows a side view of a cutter 500. The cutter 500 of FIG. 11 can be used at any one or more of the cutter locations for casing end tools such as the casing bits 100 or casing reamers shown herein. The cutter 500 is fitted with a protective cap 502 made of a material better suited for milling operations (such as tungsten carbide or CBN). In this instance the casing end tool has an enhanced capability of performing drill out through float equipment or a previously run and cemented casing end tool, or both.

In FIG. 11, the PDC cutter 500 comprises a diamond table layer 504 (or diamond face) and an underlying substrate 506 which may be made of a tungsten carbide material. The underlying substrate 506 may alternatively have the form shown in FIGS. 2A and 2B. The diamond table layer 504 may be non-leached, shallow leached, deep leached, or resubstrated fully leached, as desired.

It will be understood that the cap 502 can, in a first implementation, be installed on the PDC cutter 500 after the PDC cutter has been secured to the cutter pocket of the bit body. Alternatively, in a second implementation, the cap 502 is installed on the PDC cutter 500 before securing the combined cutter-cap assembly to the cutter pocket of the bit body. Thus, the first implementation represents, for example, a retrofitting of a manufactured PDC casing bit to include a cap on desired ones of the included PDC cutters. Conversely, the second implementation represents, for example, the fabrication of a new PDC casing bit to include a capped PDC cutter at selected locations.

FIG. 11 specifically illustrates the use of a tungsten carbide cap 502 (i.e., a cap made from tungsten carbide material). The material for the cap 502 may comprise a high toughness, low abrasion resistant tungsten carbide material, for example, a tungsten carbide material containing cobalt percentages in the 14-18% range. The cap 502 may have any desired shape, and several different shapes and configurations are discussed herein. Alternatively, as will be discussed in more detail herein, the cap 502 may alternatively be made of a metal (or metal alloy) material. Still further, that metal/metal alloy cap 502 may include a tungsten carbide or CBN tip. The cap 502 may alternatively be made of another suitable material of choice (non-limiting examples of materials for the cap include: steel, titanium, nickel and molybdenum).

The cap 502 is held in place on the PDC cutter through a bonding action between the cap and the substrate 506 of the PDC cutter 500. More specifically, a portion of the cap is bonded to a portion of, or a majority of, the substrate 506 of the installed PDC cutter that is exposed outside of the casing bit body (i.e., outside of the cutter pocket). The cap 502 is attached to the PDC cutter, in one implementation, using brazing 508 to (tungsten carbide, for example) substrate 506. The thickness of the braze material 508 illustrated in FIG. 11 is shown over-scale in order to make its location and presence clear.

Preferably, the cap 502 is not brazed (i.e., is not attached) to the diamond table layer 504 of the PDC cutter 500. Rather, a first portion 510 of the cap over the front face of the diamond table layer 504 of the PDC cutter 500 simply rests adjacent to that face, while a second portion 512 of the cap over the substrate 506 is secured to that substrate by bonding. In this context, it is recognized that PDC diamond is not wetable with standard braze material. It is important that the diamond table 504 face of the PDC cutter 500 be protected by the cap 502 without the cap being directly bonded to the face. The second portion 512 of the cap 502 adjacent the substrate 506 of the PDC, which is brazed and attached to the substrate material, may further be attached through brazing to the bit body in an area at the back of the cutter pocket. The first portion 510 of the cap 502 may also be attached through brazing to the cutter pocket (more specifically, the base of the cutter pocket below the face of the PDC cutter). In some embodiments shorter substrate PDC cutters are used to increase the bond area of the cap at the base of the cutter pocket. In some embodiments the pocket base is configured to increase the bonding area available to the cap at the same location.

Some braze material 508 may advantageously be present between the cap 502 and the front face of the diamond table layer 504 of the PDC cutter, but this material does not serve to secure the cap to the diamond table layer. In a preferred embodiment, the braze material used to braze the cap to the cutter substrate adheres to the inner surfaces of the cap that are adjacent to the diamond table face and periphery of the PDC diamond layer. This braze material provides a thin cushioning layer to limit the transfer of impact loads to the diamond layer while the caps are in use for milling casing or casing-associated equipment. The preferred configuration which does not adhere the cap to the diamond table face is preferred as this allows the cap to break free from the cutter when no longer needed (for example, once a milling operation is completed).

In an alternative embodiment the cap can be pre-mounted on the PDC cutter using a high temperature braze material in an LS bonder as is known in the art. The pre-capped PDC cutter can then be brazed into the cutter pocket of a drill bit using known brazing methods and temperatures for brazing cutters into bits.

The casing end tool of the present invention is designed to balance the requirements of drillability with the desired drilling performance characteristics needed for efficient and economical drilling with casing. To this end the current invention incorporates new technology and technology adapted from other drilling tools but modified and enhanced to meet the challenges presented by the unique geometry, clearances, and requirements of mounting a drilling tool on casing. The casing end tool of the present invention includes features to improve casing drilling performance, improve reaming, improve drillability, reduce body erosion, and increase break up and flushing of drilled out debris.

Embodiments of the invention have been described and illustrated above. The invention is not limited to the disclosed embodiments.

What is claimed is:

1. A casing end tool, comprising:

a bowl-like body defined by a wall having an outer convex surface and an inner concave surface on an opposite side of said wall from the outer convex surface, the bowl-like body having a center axis, the inner concave surface being non-axisymmetric with respect to the center axis and the outer convex surface being axisymmetric with respect to the center axis.

2. The tool of claim 1 wherein the non-axisymmetric inner concave surface is defined by a plurality of spaced apart regions of the wall having a thickness greater than a thickness of regions of the wall between said spaced apart regions.

3. The tool of claim 2 further including a plurality of blades on the outer convex surface of the wall, wherein the spaced apart regions on the inner concave surface are positioned opposite locations of junkslots formed between pairs of blades.

4. The tool of claim 2 further including a plurality of ports formed through the wall, wherein the spaced apart regions with greater thickness surround each port on the inner concave surface.

5. The tool of claim 4 further including a port sleeve for each port, the port sleeve extending above the surrounding spaced apart region.

6. The tool of claim 2 wherein the spaced apart regions comprise a raised boss structure or a raised land structure on the inner concave surface.

7. The tool of claim 1 wherein the non-axisymmetric inner concave surface is defined by a plurality of channel regions formed in the wall.

8. The tool of claim 7 further including a plurality of blades on the outer convex surface of the wall, wherein the channel regions on the inner concave surface are positioned opposite locations of the blades.

9. The tool of claim 1 further including a plurality of blades on the outer convex surface of the wall separated by junkslots, each blade supporting a plurality of cutter elements, and further including a channel formed between adjacent ones of the cutter elements and extending between junkslots.

10. The tool of claim 1 further including an inner collar ring defining a bit guide.

11. The tool of claim 1 wherein the wall of the bowl-like body comprises:

a cylindrical sidewall portion having a bottom end; and a face wall portion attached to the cylindrical sidewall portion at the bottom end.

12. The tool of claim 11 wherein the face wall portion is attached to the cylindrical sidewall portion using a threaded coupling at the bottom end.

13. The tool of claim 12 wherein the face portion comprises a plurality of pieces clamped together by engagement with the threaded coupling in a first rotation direction opposite a second rotation direction for a cutting operation of the tool.

14. The tool of claim 1 wherein the tool is one of a casing bit or a casing reamer.

15. The tool of claim 1 further including a plurality of blades on the outer convex surface of the wall, each blade supporting a plurality of cutter elements, and each cutter element comprising a diamond table mounted to a substrate of a first material.

16. The tool of claim 15 further including an additional substrate of a second material different than the first material, wherein the additional substrate is mounted to an end of the cutter opposite the diamond table.

17. The tool of claim 1 further comprising a cutting structure arranged on a face of the tool which is force balanced to less than about 10%.

18. The tool of claim 1 further comprising a cutting structure arranged on a face of the tool which is force balanced to less than about 5%.

19. The tool of claim 1 further including a plurality of blind openings formed in the inner concave surface.

20. The tool of claim 1 wherein the bowl-like body is made of one or more materials selected from the group consisting of: austemperized ductile iron, zinc alloy, titanium, aluminum, steel, crystalline tungsten, graded tungsten carbide and crystalline tungsten, copper or brass.

21. The tool of claim 20 wherein the bowl-like body of austemperized ductile iron or of steel comprises nitrided austemperized ductile iron or nitrided steel.

22. The tool of claim 1 wherein the bowl-like body is made of a material whose hardness is graded from less hard closer to the inner concave surface to more hard closer to the outer convex surface.

23. The tool of claim 1 further including a plurality of blades on the outer convex surface of the wall extending to a gage region of the tool, the gage regions of the blades having a width which narrows in a direction extending towards a rear of the tool.

24. The tool of claim 1 further including a float valve.

25. The tool of claim 1 further including a frangible bypass port.

26. A casing end tool comprising:

a bowl-like body defined by a wall having an outer convex surface and an inner concave surface opposite of the outer convex surface, the bowl-like body having a center axis, the inner concave surface being non-axisymmetric with respect to the center axis and the outer convex surface being axisymmetric with respect to the center axis; and a plurality of cutter elements, each cutter element comprising a diamond table mounted to a substrate, and a cap mounted to the substrate, wherein the cap at least partially overlies, but is not attached to, the diamond table.

27. The tool of claim 26 wherein the cap is made of or tipped with tungsten carbide.

28. The tool of claim 26 wherein the cap is made of tungsten carbide and tipped with cubic boron nitride.

29. A casing end tool, comprising:

a bowl-like body including an inner plenum and being defined by a wall having an outer convex surface and an inner concave surface opposite of the outer convex surface, the bowl-like body having a center axis, the inner concave surface including a plurality of non-axisymmetric regions defined by spaced apart portions of the wall having a thickness greater than a thickness of regions of the wall between said spaced apart portions.

30. The tool of claim 29 further including a plurality of blades on the outer convex surface of the wall, wherein the spaced apart portions on the inner concave surface are positioned opposite locations of junkslots formed between pairs of blades.

31. The tool of claim 29 wherein the spaced apart portions comprise a raised boss structure or a raised land structure on the inner concave surface.

32. The tool of claim 29 further including a plurality of blades on the outer convex surface of the wall separated by junkslots, each blade supporting a plurality of cutter elements, and further including a channel formed between adjacent ones of the cutter elements and extending between junkslots.

33. The tool of claim 29 wherein the wall of the bowl-like body comprises:

a cylindrical sidewall portion having a bottom end; and a face wall portion attached to the cylindrical sidewall portion at the bottom end.

34. The tool of claim 33 wherein the face wall portion is attached to the cylindrical sidewall portion using a threaded coupling at the bottom end.

35. The tool of claim 34 wherein the face portion comprises a plurality of pieces clamped together by engagement with the threaded coupling in a first rotation direction opposite a second rotation direction for a cutting operation of the tool.

36. The tool of claim 29 wherein the bowl-like body is made of a material whose hardness is graded from less hard closer to the inner concave surface to more hard closer to the outer convex surface.

37. The tool of claim 29 further including a plurality of blades on the outer convex surface of the wall extending to a gage region of the tool, the gage regions of the blades having a width which narrows in a direction extending towards a rear of the tool.

38. The tool of claim 29 further including a float valve.

39. The tool of claim 29 further including a frangible bypass port.

40. A casing end tool, comprising:

a bowl-like body including an inner plenum and being defined by a wall having an outer convex surface and an inner concave surface opposite of the outer convex surface, the bowl-like body having a center axis, the inner concave surface being a non-axisymmetric inner concave surface and including a plurality of channel regions formed in the wall; and a plurality of blades on the outer convex surface of the wall, wherein the channel regions on the inner concave surface are positioned opposite locations of the blades.

41. The tool of claim 40 further including a channel formed in an outer surface of at least one of the plurality of blades at a position between adjacent ones of the cutter elements.

42. The tool of claim 40 wherein the wall of the bowl-like body comprises:

a cylindrical sidewall portion having a bottom end; and a face wall portion attached to the cylindrical sidewall portion at the bottom end.

43. A casing end tool comprising:

a bowl-like body including an inner plenum and being defined by a wall having an outer convex surface and an inner concave surface opposite of the outer convex surface, the bowl-like body having a center axis;

wherein the wall of the bowl-like body comprises:

a cylindrical sidewall portion having a bottom end; and a face wall portion attached to the cylindrical sidewall portion at the bottom end;

wherein the face wall portion is attached to the cylindrical sidewall portion using a threaded coupling at the bottom end.

44. The tool of claim 43 wherein the face portion comprises a plurality of pieces clamped together by engagement with the threaded coupling in a first rotation direction opposite a second rotation direction for a cutting operation of the tool.

45. The tool of claim 40 wherein the bowl-like body is made of a material whose hardness is graded from less hard closer to the inner concave surface to more hard closer to the outer convex surface.

46. The tool of claim 40 further including a plurality of blades on the outer convex surface of the wall extending to a gage region of the tool, the gage regions of the blades having a width which narrows in a direction extending towards a rear of the tool.

47. The tool of claim 40 further including a float valve.

48. The tool of claim 40 further including a frangible bypass port.

* * * * *